US005658207A

United States Patent [19]

Aizawa et al.

[11] Patent Number: 5,658,207

[45] Date of Patent: Aug. 19, 1997

[54] GOLF CLUB HEAD

[75] Inventors: Yuichi Aizawa; Shoichi Dekura, both of Tokyo, Japan

[73] Assignee: Daiwa Seiko, Inc., Tokyo, Japan

[21] Appl. No.: 408,396

[22] Filed: Mar. 22, 1995

[30] Foreign Application Priority Data

Mar. 22, 1994 [JP] Japan ..... 6-049633

[51] Int. Cl.[6] ..... A63B 53/04

[52] U.S. Cl. ..... 473/345; 473/346; 473/344; 473/328

[58] Field of Search ..... 273/167 H, 167 F, 273/167 S, 171, 172, 169; 473/345, 346, 344, 328

[56] References Cited

U.S. PATENT DOCUMENTS

| | | | |
|---|---|---|---|
| 4,332,388 | 6/1982 | Crow | 473/328 |
| 4,417,731 | 11/1983 | Yamada | 273/167 H |
| 4,944,515 | 7/1990 | Shearer | 273/167 H |
| 5,056,705 | 10/1991 | Wakita et al. | 228/176 |
| 5,122,324 | 6/1992 | Young-sup | 273/167 H |
| 5,195,747 | 3/1993 | Choy | 273/170 |
| 5,419,559 | 5/1995 | Melanson et al. | 273/167 H |

FOREIGN PATENT DOCUMENTS 53-40380 10/1978 Japan .

*Primary Examiner*—Jennifer Bahr
*Assistant Examiner*—Charles Anderson
*Attorney, Agent, or Firm*—Longacre & White

[57] ABSTRACT

In a metal golf club head, a recess portion with a closed bottom is formed in a bottom surface of a hollow shell cast of metal, and a sole plate, made of metal greater in specific gravity than the shell, is received in and secured to the recess portion in such a manner that the sole plate lies flush with that portion of the bottom surface disposed adjacent to a peripheral edge of the recess portion. The sole plate can withstand an impact produced when hitting a ball, and is prevented from becoming disengaged from the shell.

7 Claims, 6 Drawing Sheets

GOLF CLUB HEAD

BACKGROUND OF THE INVENTION

This invention relate to a metal golf head club having a hollow shell cast of metal.

Recently, in view of the stability of quality, the ease of supply of materials and so on, there have extensively been used metal golf club heads (hereinafter referred to as "head") having a shell cast of metal, such as stainless steel, a titanium alloy and an aluminum alloy, instead of natural wood such as persimmon and cherry.

FIG. 8 shows a metal head of this type disclosed in U.S. Pat. No. 5,056,705. This head 1 comprises a shell 3 of a titanium alloy fully open at its lower end, and a sole plate 5 of pure titanium welded to the shell 3 to close this low end opening. A weight-adjusting member (weight) 7, lowering the center of gravity of the head 1, is affixed to an inner surface of the sole plate 5.

FIG. 9 shows a metal head disclosed in Japanese Pat. Examined Publication No. 53-40380, and this head 9 also comprises a shell 11 of an aluminum alloy fully open at its lower end as shown in FIG. 10, and a sole plate 13 of an aluminum alloy fixedly secured by screws to the lower end of the shell 11 to close this lower end opening as shown in FIGS. 9 and 11. Although not shown in the drawings, a weight-adjusting member is affixed to an inner surface of the sole plate 13.

FIG. 12 shows a metal head disclosed in U.S. Pat. No. 5,195,747, and this head 15 comprises a hollow shell 17 cast of metal, and a sole plate 19 of metal fixedly secured to a bottom surface (sole portion) of the shell 17. A weight-adjusting member 23 is provided in a filler 21 filled in the shell 17.

However, in the head 1 of FIG. 8, the sole plate 5 is secured to the shell 3 to close the lower end opening in this shell, and thus serves much as a lid, and a welding surface is provided only at the peripheral edge of the opening in the shell 3. Therefore, when that portion 5*a* of the peripheral surface of the sole plate 5 disposed at the face side bites into the ground 27 at the time of hitting a ball 25 as shown in FIG. 13, the sole plate 5 may be disengaged from the shell 3 because of its impact.

Such a disadvantage may also be encountered with the head 9 of FIG. 9, and when the screws 29, securing the sole plate 13 to the shell, become loosened, there is a possibility that the sole plate 13 may be disengaged from the shell 11 because of an impact produced when the sole plate bites into the ground at the time of hitting a ball. Similarly, in the head 15 of FIG. 12, there is a possibility that the sole plate 19 may be disengaged from the shell 17.

In each of the above conventional constructions, the weight-adjusting member is provided in the head to lower the center of gravity of the head. There has been made a proposal in which instead of providing such a weight-adjusting member, a sole plate is cast of metal greater in specific gravity than a shell, and is secured to the shell as is the case with the above sole plates 5 and 19, thereby adjusting the weight of the head.

Even with this construction, however, when that portion of the peripheral surface of the sole plate disposed at the face side bites into the ground at the time of hitting the ball, there is a fear that the sole plate may be disengaged from the shell because of its impact. Thus, it has been difficult to secure the sole plate of metal, which is different from that of the shell and hence provides a rather poor bonding property, to the lower surface of the shell.

SUMMARY OF THE INVENTION

The present invention has been made in view of the above problems, and an object of the invention is to provide a metal head in which a sole plate, made of metal greater in specific gravity than that of a hollow, cast shell, is secured to this shell in a manner to adjust the weight of the head so that the sole plate can withstand an impact produced when hitting a ball, thereby preventing the sole plate from becoming disengaged from the shell.

To achieve the above object, the invention provides a metal golf club head characterized in that a recess portion with a closed bottom is formed in a bottom surface of a hollow shell cast of metal; and a sole plate, made of metal greater in specific gravity than the shell, is received in and secured to the recess portion in such a manner that the sole plate lies flush with that portion of the bottom surface disposed adjacent to a peripheral edge of the recess portion.

In order to strength the mounting of the sole plate to the recess portion more positively, the following arrangements are preferable:

(1) a peripheral wall of the recess portion is slanting outwardly from an open side of the recess portion toward the bottom thereof;

(2) The sole plate has projections projecting outwardly from a peripheral edge thereof, the projections being embedded in the shell; and (3) The sole plate has convex portions formed on an upper surface thereof, the convex portions being fitted in the bottom of the recess portion formed in the bottom surface of the shell.

When swinging a golf club having the head of the invention attached thereto, the sole plate functions as a weight-adjusting member to lower the center of gravity of the head.

Even if a lower portion of the head at the face side thereof bites into the ground when hitting a ball, a force tending to disengage the sole plate from the shell will not act on the sole plate since the sole plate is secured to the recess portion in the bottom surface in such a manner that this sole plate is flush with the bottom surface, and therefore the sole plate is positively held in the recess portion.

In the head employing the arrangement of (1), the peripheral wall of the recess portion having a dovetail groove-like configuration retains the sole plate against disengagement. In the head employing at least one of the arrangements (2) and (3), the projections are embedded in the shell to prevent the disengagement of the sole plate.

DETAILED DESCRIPTION OF THE PREFERRED EMBODIMENTS

Figure 1:
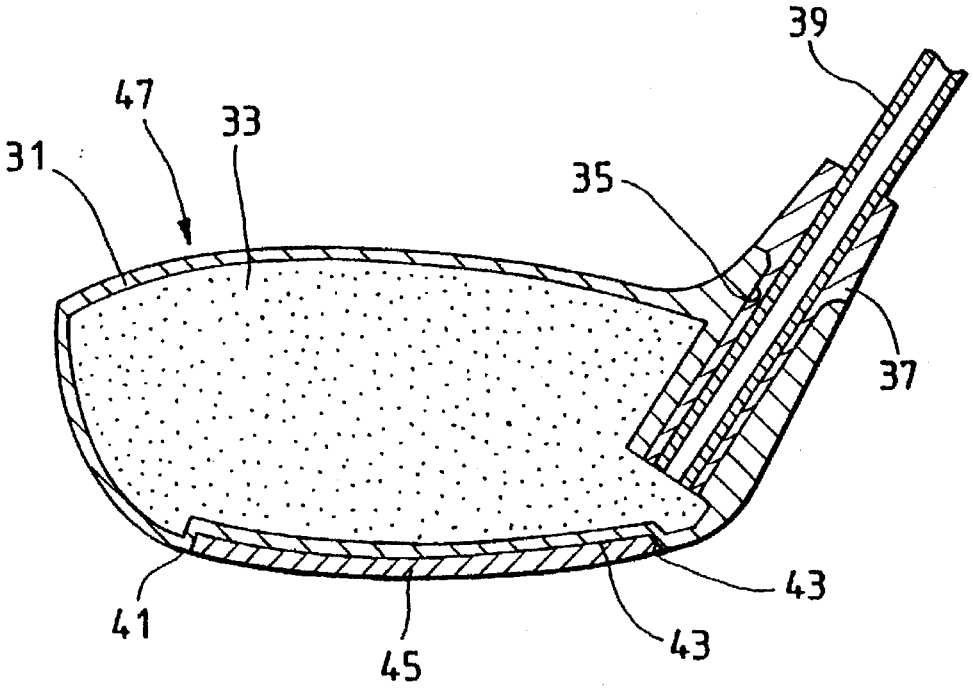
FIG. 1 is a cross-sectional view of one preferred embodiment of a head of the invention.
Figure 2:
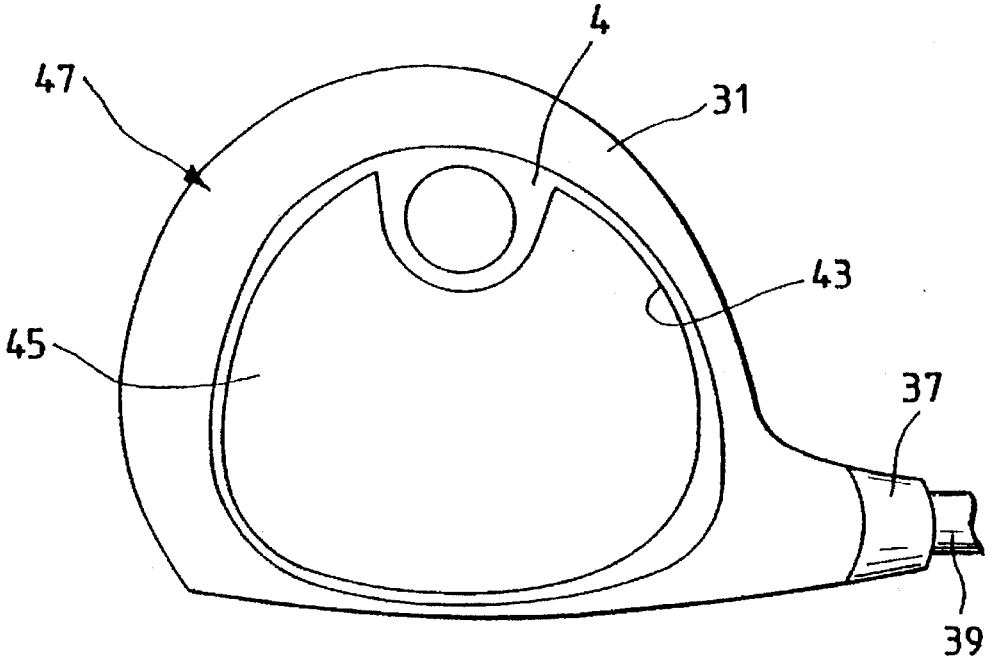
FIG. 2 is a bottom view of the head of FIG. 1.

A preferred embodiment of the present invention will now be described with reference to the drawings FIGS. 1 and 2 show one preferred embodiment of a head of the invention. In FIG. 1, a hollow shell 31 is cast of metal, such as a magnesium alloy (Specific gravity: 1.8), an aluminum alloy (Specific gravity: 2.8), a titanium alloy (Specific gravity: 4.5) and a beryllium alloy (Specific gravity: 1.9), and a filler 33 of a foamed synthetic resin is filled in this shell. The use of the smaller specific gravity material as the material of the hollow shell 31 is effective in lowering the center of gravity of the resultant head in cooperation with a sole plate 45 (described latter) attached to the hollow shell 31.

A hosel insertion portion 35 is provided in the shell 31 at a heel side thereof, and a hosel 37 is inserted in this hosel insertion portion 35, the hosel 37 being molded of a synthetic resin (e.g. an ABS resin, a polycarbonate resin, an epoxy resin, or a mixture thereof with powder of carbon, Kevlar or glass). The hosel 37 is formed of the resin generally smaller in specific gravity than metal to reduce the weight of the hosel and to lower the center of gravity of the golf club head 47. A shaft 39 formed of metal, FRP or other material is secured to the shell 31 through the hosel 37. The hosel 37 of a synthetic resin is thus interposed between the shell 31 and the shaft 39, and with this arrangement the hosel 37 functions as a cushioning member for absorbing an impact produced when hitting a ball, thereby reducing vibration to be transmitted from the shell 31 to the shaft 39.

As shown in FIG. 2, a recess portion 43 with a closed bottom is formed in a bottom surface (sole portion) 41 of the shell 31, and is projected toward the inside of the shell 31. The sole plate 45 is received in and secured to this recess portion 43 by an adhesive or welding in such a manner that the sole plate 45 lies flush with that portion of the bottom surface 41 disposed adjacent to a peripheral edge of the recess portion 43, the sole plate 45 being formed of metal (e.g. stainless steel [Specific gravity: 7.8], a copper alloy [Specific gravity: 7.8~8.9], a nickel alloy [Specific gravity: 8.7], or a cobalt alloy [Specific gravity: 8.8]) greater in specific gravity than that of the shell 31.

As shown in FIG. 1, to facilitate the adhesive bonding or welding of the sole plate 45, a peripheral wall 43*a* of the recess portion 43 is slanting outwardly from the bottom of the recess portion 43 toward the open side thereof.

The head 47 of this embodiment is of the above construction, and when swinging a golf club having this head 47 attached thereto, the sole plate 45 serves as a weight-adjusting member to lower the center of gravity of the head 47.

The hosel 37 absorbs an impact produced when hitting a ball, thereby reducing vibration to be transmitted from the shell 31 to the shaft 39.

Figure 13:
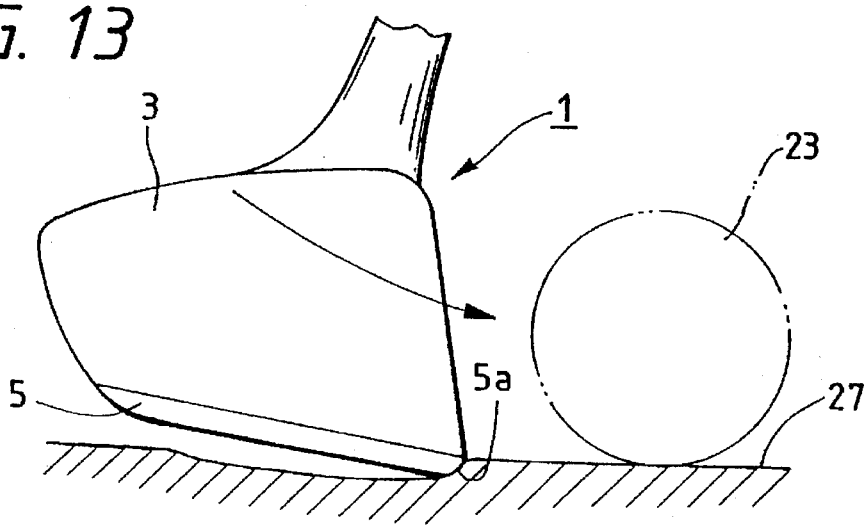
FIG. 13 is a view explanatory of a condition of the head of FIG. 8 when hitting a ball.

Even if a lower portion of the head 47 at the face side thereof bites into the ground when hitting the ball as shown in FIG. 13, a force tending to disengage the sole plate 45 from the shell 31 will not act on the sole plate 45 since the sole plate 45 is secured to the recess portion 43 in the bottom surface 41 in such a manner that this sole plate is flush with the bottom surface 41, and therefore the sole plate 45 is positively held in the recess portion 43.

In this embodiment, thus, the sole plate 45 will not be disengaged from the shell 31 by an impact produced when hitting the ball, and therefore the sole plate 45 (made of metal which is different from and greater in specific gravity than that of the shell 31) secured to the bottom surface 41 of the shell 31 can function as a weight-adjusting member to lower the center of gravity of the head 47.

Figure 3:
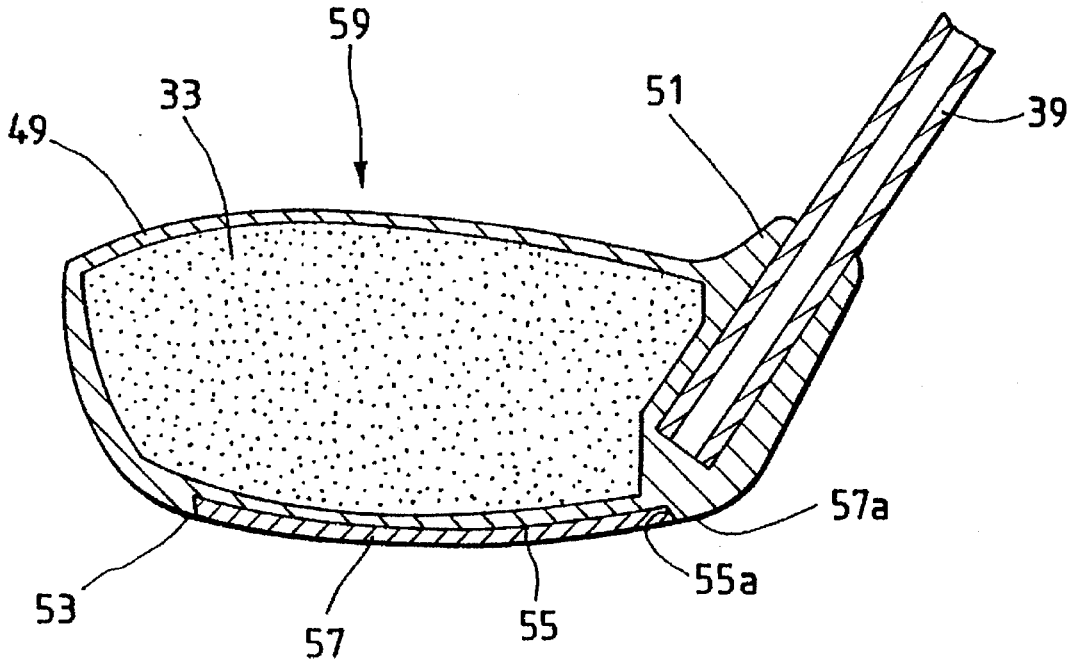
FIG. 3 is a cross-sectional view of another preferred embodiment of a head of the invention.
Figure 4:
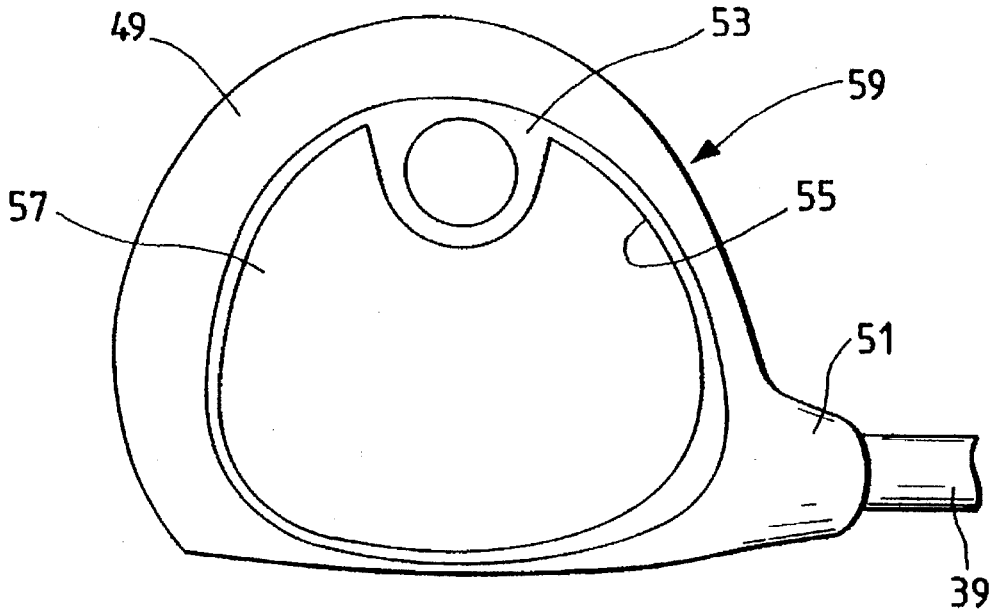
FIG. 4 is a bottom view of the head of FIG. 3.

FIGS. 3 and 4 show another preferred embodiment of a head of the invention. In FIG. 3, a hollow shell 49 is cast of the same material as that of the above-mentioned shell 31, and a shaft 39 is inserted in a hosel portion 51 formed integrally with the shell at a heel side thereof, and a filler 33 is filled in the shell 49.

As shown in FIG. 4, a recess portion 55 with a closed bottom is formed in a bottom surface (sole portion) 53 of the shell 49, and a sole plate 57, made of the same material as that of the above-mentioned sole plate 45, is received in and secured to the recess portion 55 in such a manner that this sole plate 57 lies flush with that portion of the bottom surface 53 disposed adjacent to a peripheral edge of the recess portion 55.

As shown in FIG. 3, in this embodiment, a peripheral wall 55*a* of the recess portion 55 is slanting outwardly from the open size thereof toward the bottom thereof, and a peripheral edge 57*a* of the sole plate 57 is formed into a configuration conforming to the peripheral wall 55*a*.

Although not shown in the drawings, for securing the sole plate 57 to the recess portion 55, the sole plate 57 is first placed at the open side of the recess 55, and then is press-fitted into the recess portion 55 by a die to deform the peripheral edge 57*a* into a configuration conforming to the peripheral wall 55*a*.

The head 59 of this embodiment is of the above construction, and when swinging a golf club having this head 59 attached thereto, the sole plate 57 serves as a weight-adjusting member to lower the center of gravity of the head 59 as described above for the preceding embodiment.

Even if a lower portion of the head 59 at the face side thereof bites into the ground when hitting the ball as shown in FIG. 13, the sole plate 57 will not be disengaged from the shell 49 by an impact since the sole plate 57 is secured to the recess portion 55 in the bottom surface 53 in such a manner that this sole plate is flush with the bottom surface 53, and besides the peripheral wall 55*a* of the recess portion 55 exhibits a dovetail groove-like configuration to retain the sole plate 57 against disengagement. Therefore, the sole plate 57 is held in the recess portion 55 more positively than in the preceding embodiment.

In this embodiment, thus, since the sole plate 57 is retained in the recess portion 55 more positively than in the preceding embodiment, the sole plate 57 will not be disengaged from the shell 49 by an impact produced when hitting the ball, and therefore the sole plate 57 (made of metal which is different from and greater in specific gravity than that of the shell 49) secured to the bottom surface 53 of the shell 49 can function as a weight-adjusting member to lower the center of gravity of the head 59.

Figure 5:
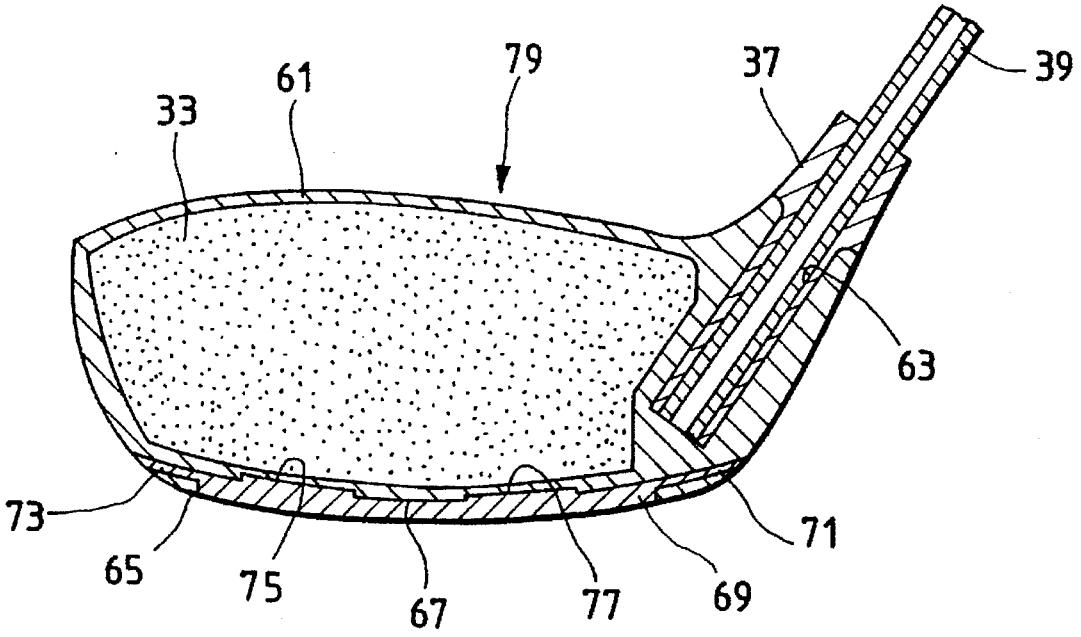
FIG. 5 is a further preferred embodiment of a head of the invention.
Figure 6:
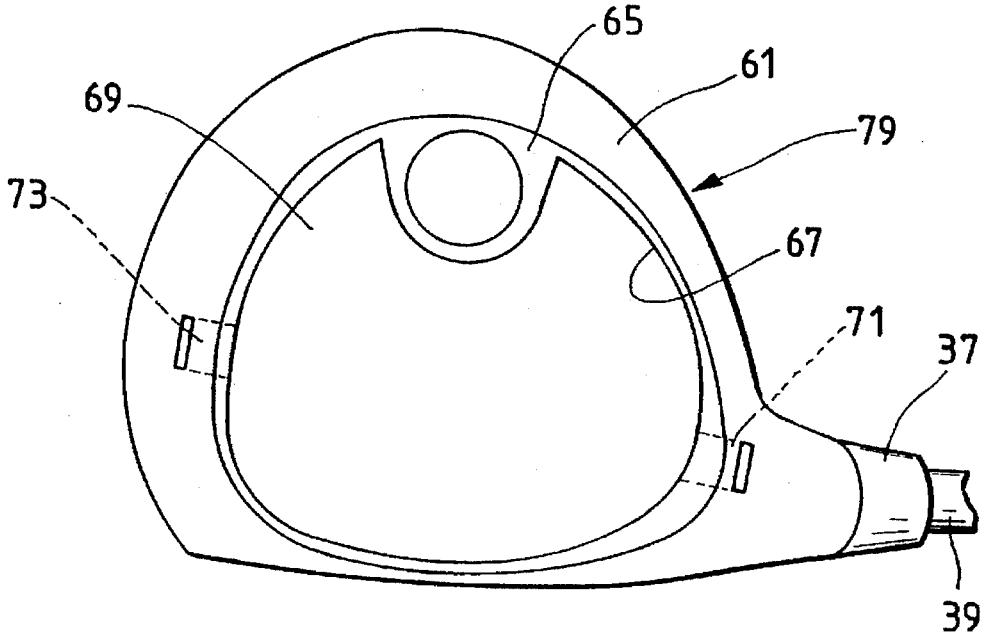
FIG. 6 is a bottom view of the head of FIG. 5.
Figure 7:
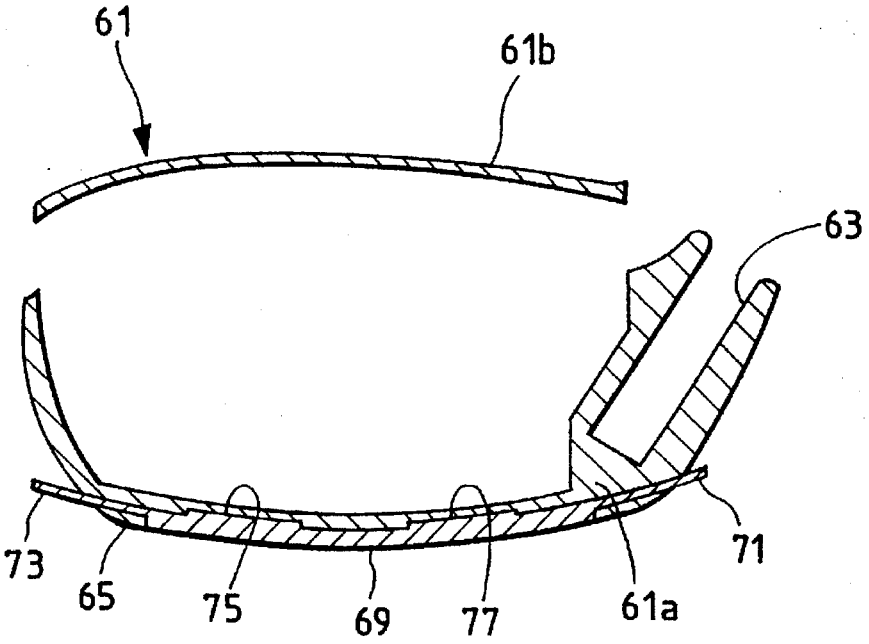
FIG. 7 is an exploded, perspective view of a shell of the head of FIG. 5.
Figure 8:
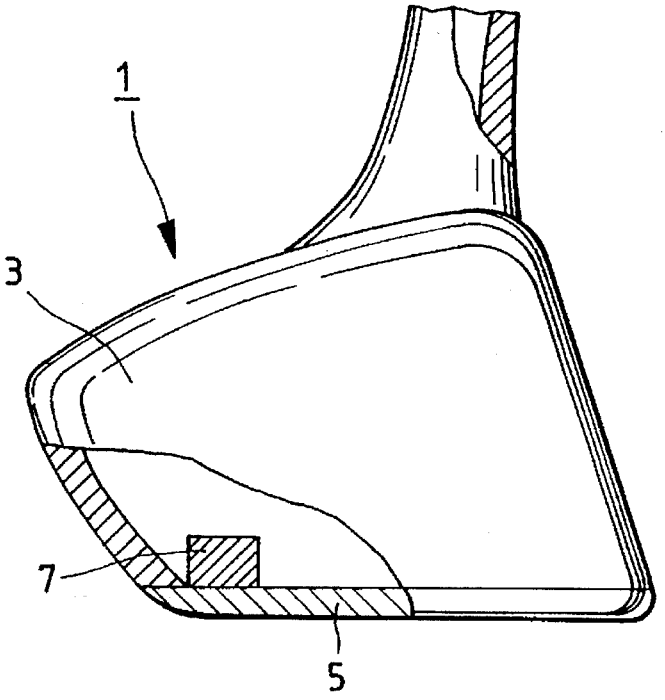
FIG. 8 is a partly-broken view of a conventional head.
Figure 9:
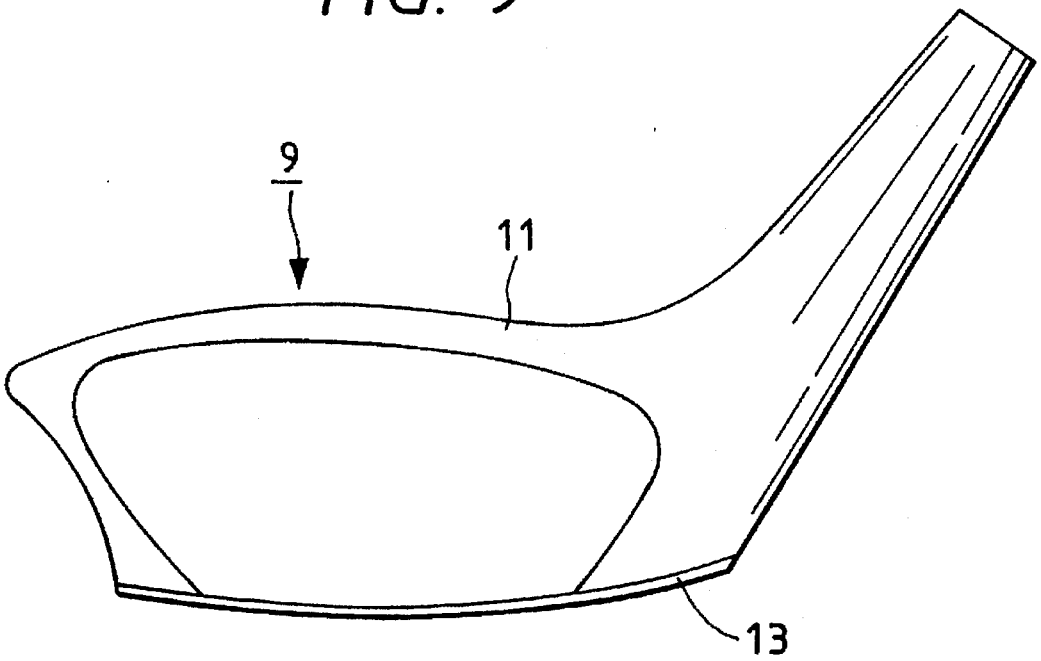
FIG. 9 is a front-elevational view of another conventional head.
Figure 10:
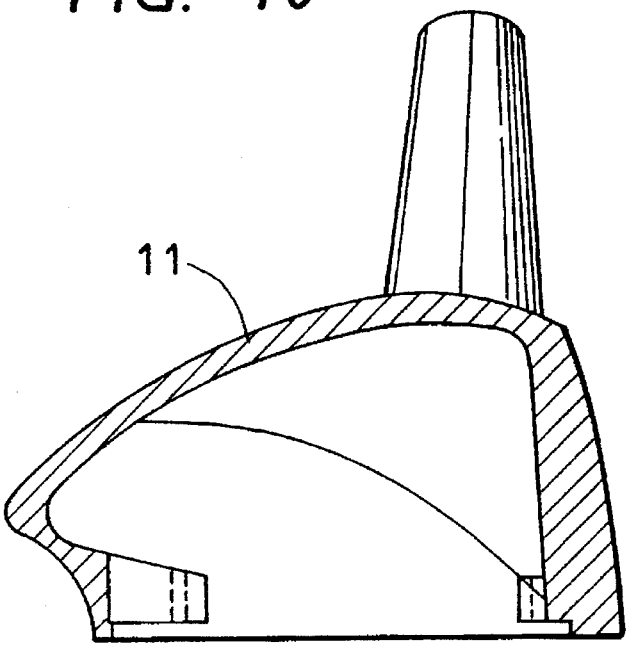
FIG. 10 is a cross-sectional view of a shell of the head of FIG. 9.
Figure 11:
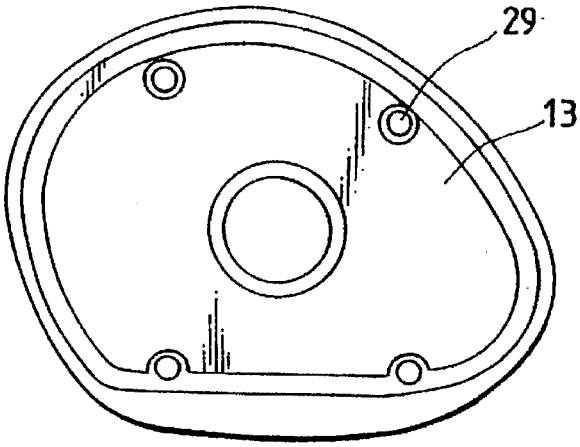
FIG. 11 is a bottom view of the head of FIG. 9.
Figure 12:
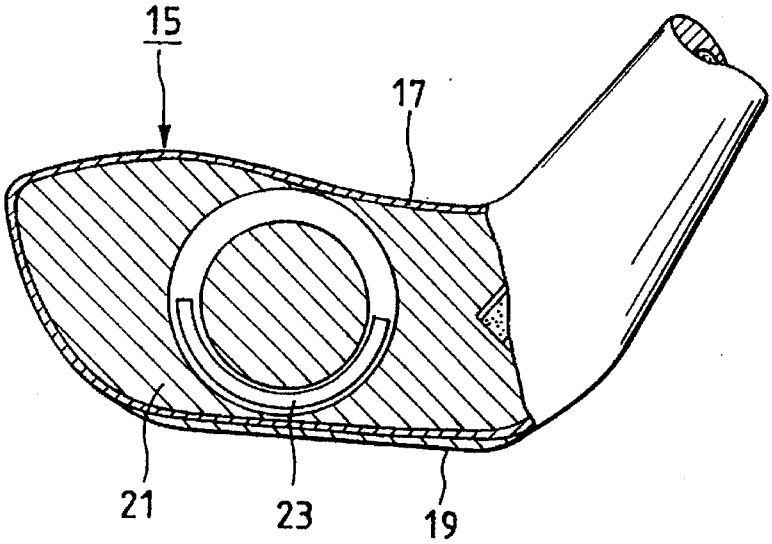
FIG. 12 is a partly-broken view of a further conventional head.

FIGS. 5 to 7 show a further preferred embodiment of a head of the invention. In FIG. 5, a hollow shell 61 is cast of the same material as that of the above-mentioned shell 31, and a hosel insertion portion 63 is provided in this shell at a heel side thereof, and a shaft 39 is inserted in this hosel insertion portion 63 through a hosel 37.

As shown in FIG. 6, a recess portion 67 with a closed bottom is formed in a bottom surface (sole portion) 65 of the shell 61, and a sole plate 69, made of the same material as that of the above-mentioned sole plate 45, is received in and secured to the recess portion 67 in such a manner that this sole plate 69 lies flush with that portion of the bottom surface 65 disposed adjacent to a peripheral edge of the recess portion 67. The sole plate 69 has a pair of projections 71 and 73 formed integrally therewith at a peripheral edge portion thereof, the projections 71 and 73 projecting toward a heel side and a toe side of the shell 61, respectively. The projections 71 and 73 are embedded in the shell 61.

For forming the shell 61, a shell body 61*a* and a top portion 61*b* are cast separately from each other as shown in FIG. 7, and then the two are joined together by welding to provide the shell. In the internal-chill casting of the shell body 61*a*, the sole plate 69 is placed in a mold through the projections 71 and 73, and then metal is poured into a cavity in the mold, so that the projections 71 and. 73 are embedded in the resulting shell body 61*a*. Then, those portions of the projections 71 and 73 projecting outwardly from the shell body 61*a* are cut off in such a manner that the cut ends of these projections lie flush with the outer surface of the shell body 61*a*. Then, the shell body 61*a* and the top portion 61*b* are welded together, thereby producing the shell 61.

As shown in FIG. 5, the sole plate 69 has convex portions 75 and 77 formed on its upper surface, and these convex portions 75 and 77 are fitted in the bottom of the recess portion 67.

The head 79 of this embodiment is of the above construction, and when swinging a golf club having this head 79 attached thereto, the sole plate 69 serves as a weight-adjusting member to lower the center of gravity of the head 79 as described above for the above embodiments.

Even if a lower portion of the head 79 at the face side thereof bites into the ground when hitting the ball as shown in FIG. 13, the sole plate 69 will not be disengaged from the shell 61 by an impact since the sole plate 69 is secured to the recess portion 67 in the bottom surface 65 in such a manner that this sole plate is flush with the bottom surface 65, and besides the pair of projections 71 and 77 formed on the sole plate 69 are embedded in the shell 61, and further the convex portions 75 and 77 are fitted in the bottom of the recess portion 67, so that the sole plate 67 is joined to the bottom of the recess portion 67 over a wide area. Therefore, the sole plate 69 is held in the recess portion 67 still more positively.

In this embodiment, thus, since the sole plate 69 is retained in the recess portion 67 more positively than in the above embodiments, the sole plate 69 will not be disengaged from the shell 61 by an impact produced when hitting the ball, and therefore the sole plate 69 (made of metal which is different from and greater in specific gravity than that of the shell 61) secured to the bottom surface 65 of the shell 61 can function as a weight-adjusting member to lower the center of gravity of the head 79.

As described above, in the head according to the present invention, the recess portion with closed bottom is formed in the shell, and the sole plate is secured to that recess portion. Therefore, no screw is necessary to secure the sole plate to the shell. That is, the hollow shell of the invention does not require screw holes, and can assure the larger strength. Further, since the sole plate is received in and secured to the recess portion in such a manner that the sole plate lies flush with the bottom surface (sole surface) of the shell. Thus, even if the shell and the sole plate, which are secured to each other, are made of different materials, the sole plate will not be disengaged from the shell by an impact produced when hitting the ball, and therefore the sole plate (made of metal which is different from and greater in specific gravity than that of the shell) secured to the bottom surface of the shell can function as a weight-adjusting member to lower the center of gravity of the head.

What is claimed is:

1. A metal golf club head comprising:

a hollow shell made of metal, said hollow shell having a bottom surface; and a recess portion extending inwardly from said bottom surface, said recess portion having an inner peripheral wall and a bottom recess portion; and a sole plate having a front, back and peripheral surface, said sole plate being made of metal greater in specific gravity than said shell, said sole plate being received in said recess portion so that said sole plate lies flush with a portion of said bottom surface wherein, said sole plate includes at least one projection projecting outwardly from said peripheral surface, said at least one projection extending through said inner peripheral wall of said recess and at least partially embedded within said shell.

2. A metal golf club head according to claim 1, wherein said hollow shell is made of one of magnesium, aluminum, titanium and beryllium.

3. A metal golf club head according to claim 1, wherein said open end is smaller in area than said bottom, and said peripheral wall slants outwardly from said open end toward said bottom.

4. A metal golf club head according to claim 3, wherein a peripheral edge of said sole plate has a configuration conforming to said peripheral wall slanting outwardly from said open end toward said bottom.

5. A metal golf club head according to claim 1, further comprising:

a hosel made of synthetic resin and mounted to said shell.

6. A metal golf club head according to claim 1, wherein said sole plate is in surface contact with said hollow shell.

7. A metal golf club head according to claim 1, wherein said sole plate is secured to said hollow shell by adhesive, welding, press-fitting or internal-chill casting.

* * * * *